US009487937B2

(12) United States Patent
Swart et al.

(10) Patent No.: US 9,487,937 B2
(45) Date of Patent: Nov. 8, 2016

(54) TOILET COUPLING

(75) Inventors: Peter William Swart, Oostburg, WI (US); John F. Emmerling, Howards Grove, WI (US); Scott W. Stonecipher, Kewaskum, WI (US); Billy Jack Ahola, Manitowac, WI (US)

(73) Assignee: KOHLER CO., Kohler, WI (US)

( * ) Notice: Subject to any disclaimer, the term of this patent is extended or adjusted under 35 U.S.C. 154(b) by 569 days.

(21) Appl. No.: 13/478,736

(22) Filed: May 23, 2012

(65) Prior Publication Data

US 2013/0312172 A1 Nov. 28, 2013

(51) Int. Cl.

| | |
|---|---|
| ***E03D 1/34*** | (2006.01) |
| ***E03D 1/26*** | (2006.01) |
| ***E03D 11/17*** | (2006.01) |

(52) U.S. Cl.

CPC ..... *E03D 1/26* (2013.01); *E03D 11/17* (2013.01); *Y10T 137/0491* (2015.04)

(58) Field of Classification Search

CPC ..... E03D 1/26; E03D 11/17; E03D 1/263; E03D 1/266

USPC ..... 4/378, 417–419, 252.1–252.5, 353, 4/DIG. 7; 248/212, 219.3

See application file for complete search history.

(56) References Cited

U.S. PATENT DOCUMENTS

| | | | | |
|---|---|---|---|---|
| 2,108,625 | A * | 2/1938 | Tilden | E03D 1/26 4/417 |
| 2,743,460 | A | 5/1956 | Youngstrom et al. | |
| 3,142,845 | A * | 8/1964 | Fulton | E03D 1/26 285/136.1 |
| 3,669,171 | A | 6/1972 | Yavitch | |
| 4,240,606 | A | 12/1980 | Johnson | |
| 4,757,560 | A * | 7/1988 | Grimstad | E03D 1/26 277/640 |
| 4,850,063 | A | 7/1989 | Abbate | |
| 4,907,301 | A | 3/1990 | Tucker | |
| 4,924,533 | A | 5/1990 | Stairs, Jr. | |
| 5,295,273 | A | 3/1994 | Unger et al. | |
| 6,725,468 | B2 * | 4/2004 | Molina | E03D 11/16 138/89 |
| 6,728,976 | B1 * | 5/2004 | Halloran | E03D 1/26 4/417 |
| 7,913,328 | B2 | 3/2011 | Halloran | |
| 2008/0066223 | A1 * | 3/2008 | Halloran | E03D 1/26 4/353 |

FOREIGN PATENT DOCUMENTS

| | | |
|---|---|---|
| CN | 1514085 | 7/2004 |
| CN | 200720119109 | 3/2007 |
| CN | 200910203241 | 5/2009 |

OTHER PUBLICATIONS

Notice of First Office Action regarding Chinese Application No. 201310195255.3

* cited by examiner

*Primary Examiner* — Paul R Durand
*Assistant Examiner* — Nicholas Ros
(74) *Attorney, Agent, or Firm* — Foley & Lardner LLP

(57) ABSTRACT

A toilet comprising a tank having a bottom, a bowl, and an attachment assembly configured to secure the bottom of the tank to the bowl. The attachment assembly includes a mounting bracket having at least three mounting locations spaced apart around an opening, a valve configured to fluidly connect the tank and the bowl, the valve being configured to engage the bottom of the tank and the opening in the mounting bracket, a valve nut configured to couple to the valve to secure the mounting bracket between the valve nut and the tank, and at least three fasteners configured to secure the mounting bracket to the bowl. The at least three fasteners are disposed external to the tank and couple the tank to the bowl without directly engaging the tank.

20 Claims, 6 Drawing Sheets

TOILET COUPLING

BACKGROUND

The present application relates generally to the field of toilets. More specifically, the application relates to an improved attachment assembly for coupling a toilet tank to a toilet bowl.

SUMMARY

An exemplary embodiment relates to a toilet comprising a tank having a bottom, a bowl, and an attachment assembly configured to secure the bottom of the tank to the bowl. The attachment assembly includes a mounting bracket having at least three mounting locations spaced apart around an opening, a valve configured to fluidly connect the tank and the bowl, the valve being configured to engage the bottom of the tank and the opening in the mounting bracket, a valve nut configured to couple to the valve to secure the mounting bracket between the valve nut and the tank, and at least three fasteners configured to secure the mounting bracket to the bowl. The at least three fasteners are disposed external to the tank and couple the tank to the bowl without directly engaging the tank.

Another exemplary embodiment relates to an attachment assembly for securing a toilet tank to a toilet bowl. The attachment assembly includes a mounting bracket having at least three mounting locations spaced apart around an opening, a valve configured to engage the opening in the mounting bracket to fluidly connect the tank and the bowl, a valve nut configured to couple to the valve to secure the mounting bracket between the tank and the valve nut, and at least three fasteners configured to secure the mounting bracket to the bowl. The at least three fasteners are disposed external to the tank and couple the tank to the bowl without directly engaging the tank.

Yet another exemplary embodiment relates to a method for securing a toilet tank to a toilet bowl through an attachment assembly. The method includes the steps of engaging a valve to the tank through an opening in the tank, moving a mounting bracket over the valve through an opening in the mounting bracket to position the mounting bracket adjacent to the tank, the mounting bracket having at least three mounting locations with fasteners attached thereto, coupling a valve nut to the valve to secure the mounting bracket between the tank and the valve nut, and securing the mounting bracket to the bowl through the fasteners. The at least three fasteners are disposed external to the tank and couple the tank to the bowl without directly engaging the tank.

DETAILED DESCRIPTION

With general references to the Figures, disclosed herein are various embodiments of toilets having an improved attachment assembly for coupling a toilet tank to a toilet bowl. The attachment assembly may include a bracket disposed adjacent to the bottom of the toilet tank, a valve that is configured to pass from inside the tank through the bottom of the tank and through the bracket to couple the tank and bracket together, and a plurality of fasteners configured to couple the bracket to the bowl. The bracket may be configured as having at least three attachments or mounting locations. For example, the bracket may be configured as having a triangular shape with an opening provided near each corner of the triangular bracket, where each opening is configured to receive a fastener for coupling the bracket to the bowl of the toilet. The attachment assembly may secure the tank to the bowl in a manner where only a single opening is required in the tank to couple the tank to the bowl, where the opening is for the valve to pass through. Thus, the fasteners of the attachment assembly secure the tank to the bowl without passing through clearance holes in the bottom of the tank. This arrangement eliminates the exposure of the fasteners to the water in the tank, which reduces or eliminates corrosion of the fasteners and eliminates a potential leak condition or location, since such clearance holes are not required for this attachment assembly. Conventional coupling methods that involve fasteners that pass through the tank (e.g., the bottom wall) to engage the bowl are prone to leaking between each clearance hole and respective fastener. The attachment assemblies disclosed herein may also be configured to secure the tank to the bowl through a plurality of attachment locations (e.g., three or more attachment locations), where the attachment locations are arranged to allow for easy adjustment (e.g., leveling) of the tank position relative to the position of the bowl. By having at least three attachment locations, such as in a triangular configuration, the attachment assembly allows for greater (and easier) adjustment of the tank relative to the bowl, such as, to allow a customer to level the tank relative to the floor on which the bowl is secured.

Figure 1:
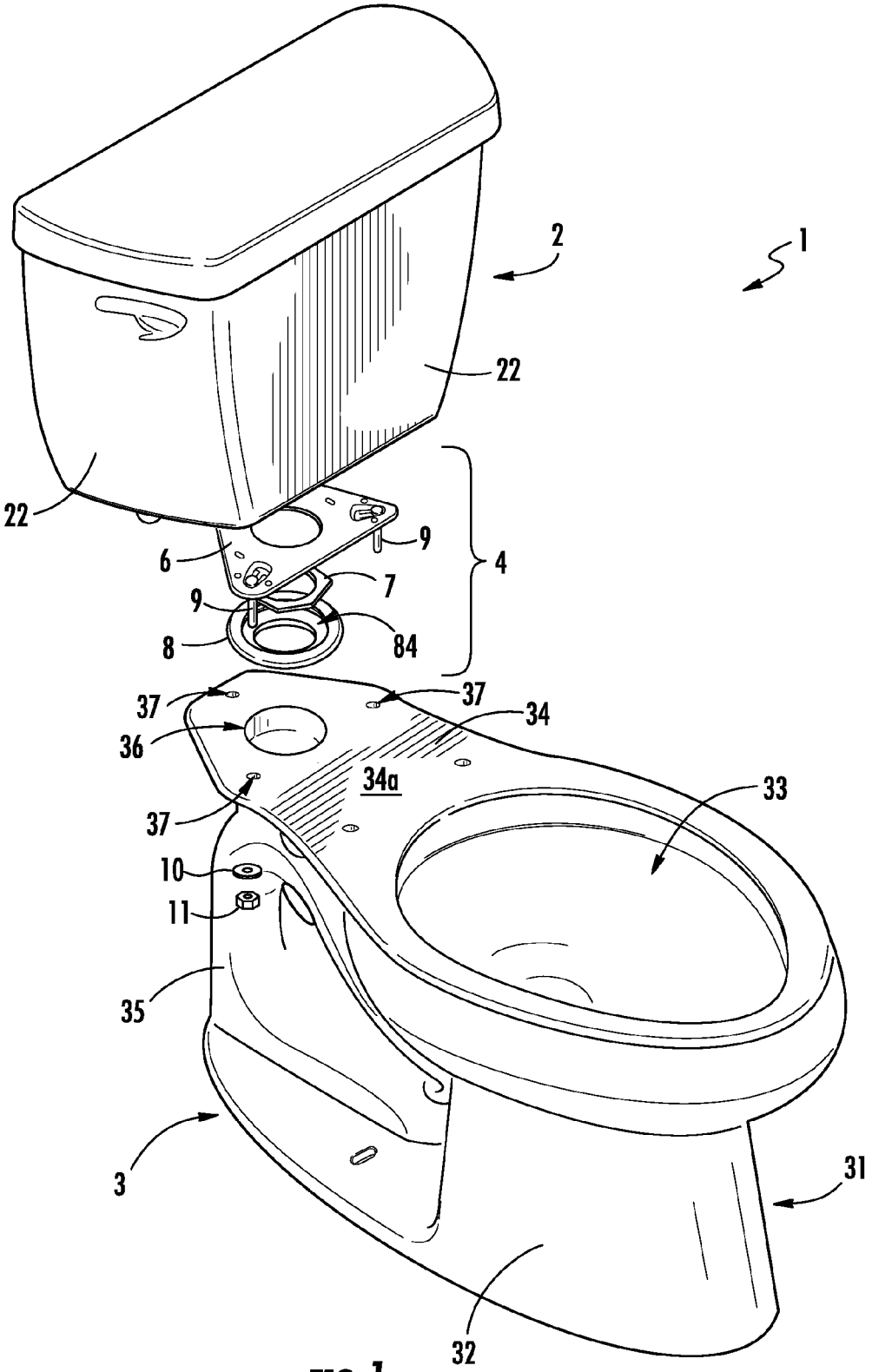
FIG. 1 is a partially exploded perspective view of an exemplary embodiment of a toilet having a coupling assembly for attaching the tank to the bowl.
Figure 2:
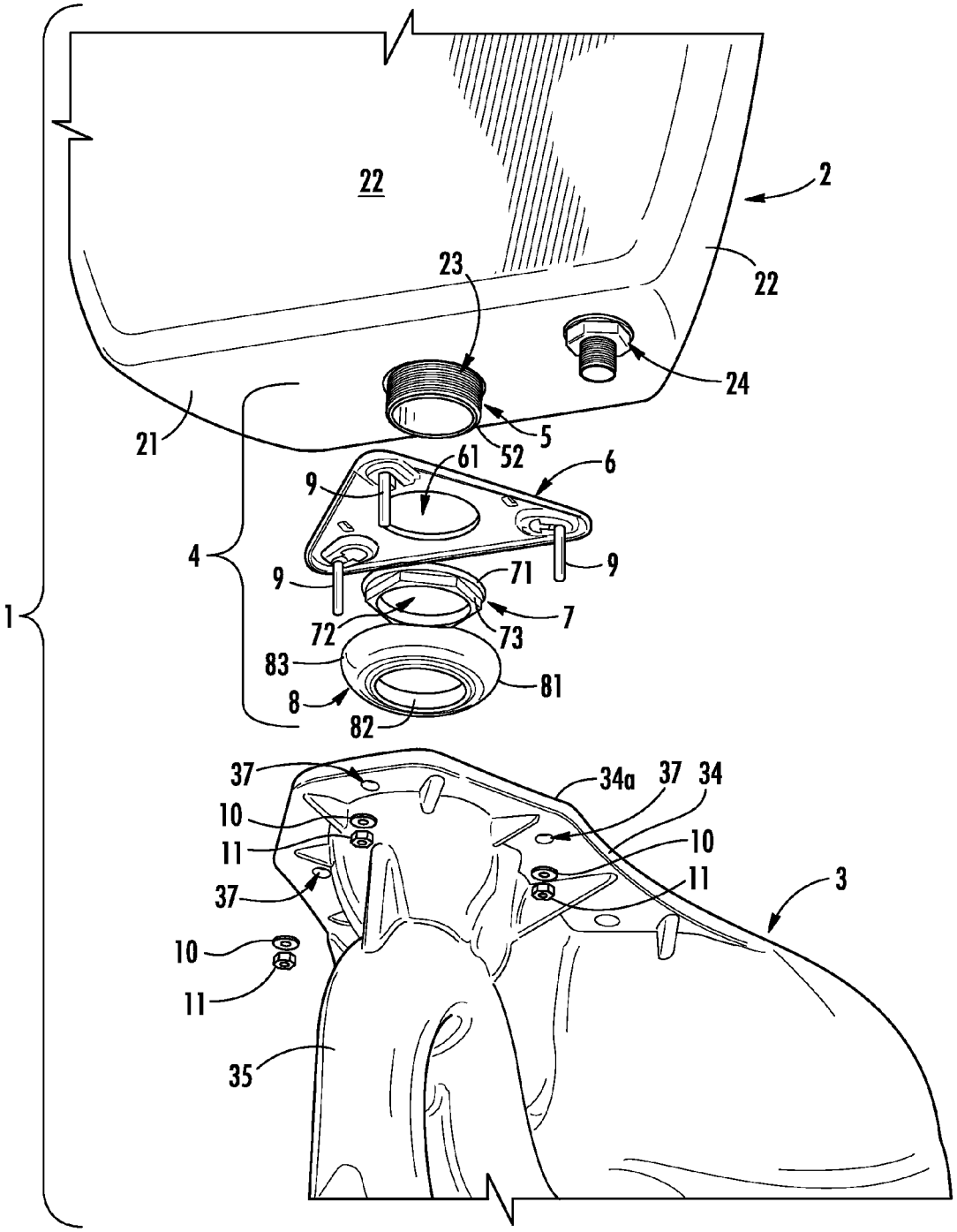
FIG. 2 is another partially exploded perspective view of the toilet of FIG. 1.
Figure 3:
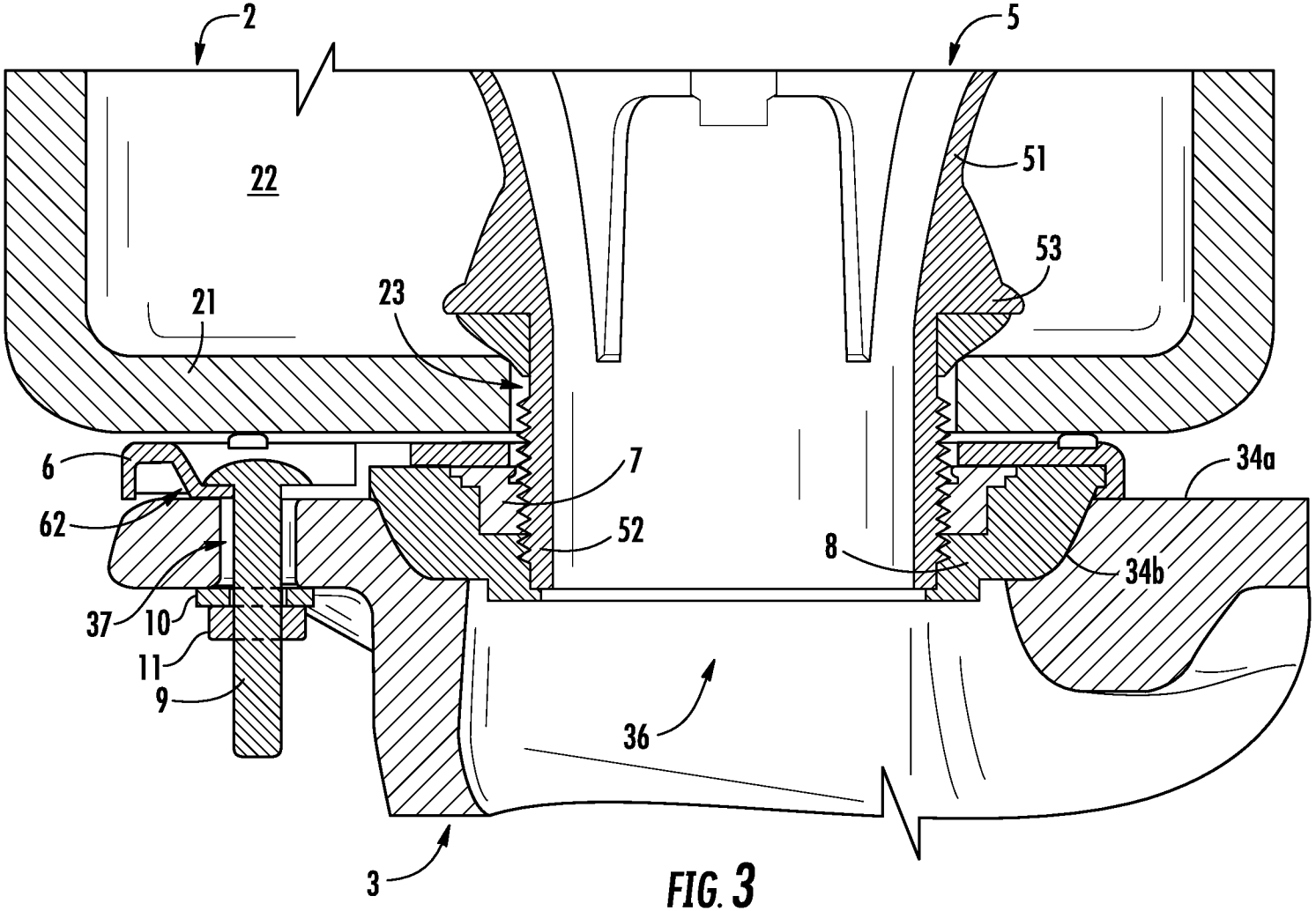
FIG. 3 is a cross-sectional view of the of the toilet of FIG. 1.

FIGS. 1-3 illustrate an exemplary embodiment of a toilet 1 that includes a tank 2, a bowl 3, and a attachment assembly 4 for securing (e.g., attaching, coupling, connecting) the tank 2 to the bowl 3. The attachment assembly 4 includes a valve 5 (e.g., a flush valve assembly), a mounting bracket 6, a valve nut 7, and a gasket 8 (e.g., grommet). The attachment assembly 4 may include a fastener 9 (e.g., bolts, screws, rivets, etc.) for securing the attachment assembly 4 to the bowl 3. As shown, the attachment assembly 4 includes three fasteners 9 that are configured to secure the mounting bracket 6 to the bowl 3 at three spaced apart locations defined by the mounting bracket 6. Each fastener 9 may be configured to engage, such as through a threaded engagement, the bowl 3, a receiving member (e.g., a nut, which is not shown), or any suitable member to retain the fastener in place to secure the attachment assembly 4 to the bowl 3. As shown in FIG. 2, each of the three fasteners 9 is configured to engage a nut 11 provided on the underside of a ledge of the bowl 3 to secure the attachment assembly 4 to the bowl 3 through a clamp load. Also as shown, a washer 10 may be disposed between the underside of the bowl 3 and each nut 11. It should be noted that the attachment assembly 4 may be coupled to the bowl 3 using any suitable method, and the examples disclosed herein are not limiting.

The tank 2 includes a bottom 21 and a plurality of side walls 22 that extend from the bottom 21 to form a hollow container (e.g., bowl) defining a cavity for holding the water therein for use during operational (or flushing) cycles. The top of the tank 2 may be open to allow access to the cavity through the top opening, which may be selectively covered by a lid or cover (not shown). The tank 2 may also house other components of the toilet 1 therein, such as the valve 5 and/or a float or floats (not shown). As shown in FIG. 2, the bottom 21 of the tank 2 includes an outlet opening 23 (e.g., central opening) where the valve 5 is configured to extend from inside the tank 2 through the outlet opening 23 to engage the attachment assembly 4. As shown, the outlet opening 23 is configured as a circular opening, to conform to the shape of the valve 5 that extends therethrough. However, the outlet opening 23 may have any suitable shape, such as to conform to different shaped valves. The tank 2 may also include an inlet opening 24 configured to receive water from a coupled water supply (not shown), such as from a hose (e.g., line, tube) through a fitting.

The bowl 3 includes a base 31 (e.g., pedestal) having walls 32 that extend to a rim to define the bowl shaped opening 33 (e.g., receptacle, sump), a ledge 34 (e.g., plateau) extending rearward from the rim of the bowl shaped opening 33, and a trapway 35 (e.g., passageway) that extends from an outlet opening in the bowl 3 to an exiting device, such as a trap or soil pipe. The ledge 34 is configured to provide a mounting surface for securing the tank 2 thereto through the attachment assembly 4. As shown, the ledge 34 is configured as having a relatively flat upper surface 34*a* that is configured to support the coupled tank 2 and attachment assembly 4 when secured to the ledge 34 of the bowl 3. The ledge 34 also includes a circular beveled surface 34*b* (e.g., a chamfer) that is configured to receive the gasket 8 in order to seal the connection between the attachment assembly 4 and the bowl 3 to prohibit leaking therebetween. Within the circular beveled surface 34*b* of the ledge 34 is disposed an inlet opening 36 that is configured to receive the flow of water therethrough, such as from the valve 5, to enter into the bowl 3. The ledge 34 of the bowl 3 may also include one or more holes 37 (e.g., openings, apertures) for coupling the attachment assembly 4 to the bowl 3. As shown, the ledge 34 includes three spaced apart holes 37, where each hole 37 is configured to receive a fastener 9 to secure the attachment assembly 4 (and tank 2 coupled thereto) to the ledge 34 of the bowl 3. The toilet 1 may include a member (e.g., nut) that is configured to receive and retain the fastener 9. For example, the bowl 3 may include a nut (not shown) attached to (or integrally formed with) the bowl 3, such as provided on the underside (e.g., on the bottom surface) of the ledge 34, for the fastener 9 to screw into in order to secure the tank 2 to the bowl 3 though a clamping force from the fastener 9 and nut. The ledge 34 may also provide for coupling of a seat assembly (not shown) thereto, and may include additional apertures or openings for coupling the seat.

The valve 5 (e.g., flush valve assembly) is configured to control the flow of water from the tank 2 into the bowl 3 through the inlet opening 36. In other words, the valve 5 is configured to operate in at least two modes of operation: a first closed mode of operation where water is prohibited from exiting the tank 2 through the valve 5 to the bowl 3, and a second open mode of operation where water is allowed to exit from the tank 2 to the bowl 3 through the valve 5. Additionally, the valve 5 and valve nut 7 are configured to couple the attachment assembly 4 to the tank 2 through the connection (e.g., threaded connection) of the valve 5 and valve nut 7. The valve 5 may include a hollow valve body 51 that extends through the outlet opening 23 of the tank 2 and through the mounting bracket 6 to be connected to the valve nut 7. The hollow valve body 51 allows fluid (e.g., water) to pass through the valve 5 from the tank 2 to the bowl 3 when the valve 5 is configured in an open position, such as during a flush cycle of the toilet 1. It should be noted that the valve 5 may be configured as a canister-type flush valve, a flapper-type flush valve, or as any suitable type of flush valve that controls the flow of water from the tank 2 to the bowl 3 during a flush cycle. An end 52 (e.g., a lower end) of the valve body 51 is configured to be coupled to the valve nut 7. For example, the end 52 of the valve body 51 may include external threads configured to thread to internal threads provided on the valve nut 7.

FIGS. 4-10 illustrate an exemplary embodiment of a mounting bracket 6 that is configured to help secure the tank 2 to the bowl 3 through the attachment assembly 4. The mounting bracket 6 may include a relatively flat base 60, such as a stamped metal (e.g., steel, stainless) base 60. As shown, the base 60 has a generally triangular shape. However, the base 60 may be configured having any suitable shape. Disposed in the base 60 is an opening 61 (e.g., aperture, hole, cutout, etc.) that is configured to receive the end 52 of the valve 5 so that the mounting bracket 6 may slide over the valve body 51, such as during attachment of the tank 2 to the bowl 3 through the attachment assembly 4. As shown, the opening 61 is a circular hole having a diameter that is at least slightly greater than the outer diameter of the valve body 51, where the opening 61 is centrally located with respect to the generally triangular shape of the mounting bracket 6.

The base 60 of the mounting bracket 6 may include a top surface 60*a* and a bottom surface 60*b*. The top surface 60*a* of the base 60 is configured to be disposed toward the bottom surface of the bottom 21 of the tank 2. For example, the top surface 60*a* of the mounting bracket 6 may be configured to abut the bottom 21 of the tank 2, or may be configured to be adjacent to and offset a distance from the bottom 21 of the tank 2. The bottom surface 60*b* of the base 60 is configured to be disposed toward the valve nut 7 and/or the gasket 8 of the attachment assembly 4. For example, during assembly of the tank 2 and valve 5, the valve nut 7 may be threaded onto the valve body 51 to clamp the mounting bracket 6 in place between the tank 2 and the valve nut 7. Accordingly, the bottom surface 60*b* may abut or may be adjacent to (and offset from) the valve nut 7, following assembly.

The mounting bracket 6 includes a plurality of mounting locations 62, where each mounting location 62 is configured to help secure the mounting bracket 6 to another component of the toilet 1, such as to the bowl 3. As shown, the mounting bracket 6 includes three mounting locations 62, with one mounting location 62 provided near each of the three corners of the generally triangular shaped mounting bracket 6. This arrangement provides stability when securing the tank 2 to the bowl 3 of the toilet 1, while also providing easy adjustability of the tank 2 relative to the bowl 3, such as through adjustment of one or more of the fasteners 9 coupling the mounting bracket 6 through the respective mounting location(s) 62 to the bowl 3. Thus, this arrangement allows for the tank 2 to be easily leveled with respect to the bowl 3 by adjusting one (or more) of the fasteners 9, which may cause the tank 2 to tilt in a substantially forward or substantially rearward direction relative to the bowl 3.

Figure 4:
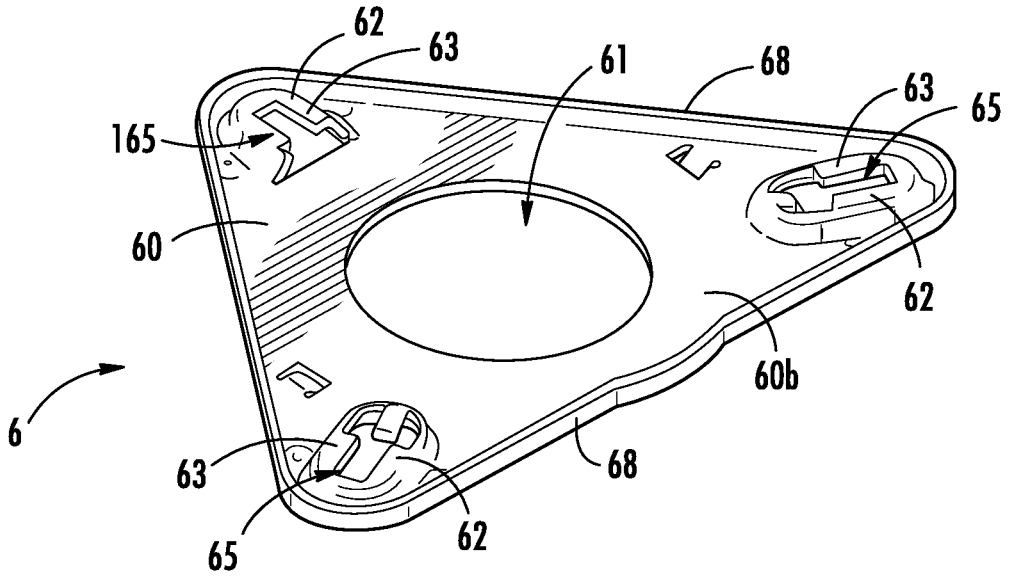
FIG. 4 is a perspective view of an exemplary embodiment of a mounting bracket for use in a coupling assembly of a toilet.

Each mounting location 62 includes a mounting surface 63 that is offset from the bottom surface 60*b* of the base 60, thereby forming a recessed pocket 64 on the top-side of the mounting bracket 6. As shown in FIG. 4, each mounting surface 63 is formed from the base 60 and is configured at a predetermined offset distance from the base 60. Each mounting surface 63 may be configured to be substantially parallel from the base 60 or may be configured at an angle of incline relative to the base 60, such as to accommodate the mating shape of the bowl 3. Each pocket 64 is configured to house a portion (e.g., a head) of the fastener 9 that engages the respective mounting location 62. Accordingly, the depth of the recess (e.g., the offset distance between the base 60 and the mounting surface 63) may be tailored to accommodate different sized fasteners or other design parameters.

Each mounting location 62 includes an aperture 65 (e.g., opening, hole, cutout) provided therein, such as to allow a connecting member (e.g., a fastener 9) to pass through the aperture 65 for coupling the mounting bracket 6 to the bowl 3. The aperture 65 may be provided in the mounting surface 63 of the mounting bracket 6. The mounting bracket 6 may include multiple apertures having similar or different configurations. For example, the mounting bracket 6 may include two apertures 65 and one aperture 165.

Figure 9:
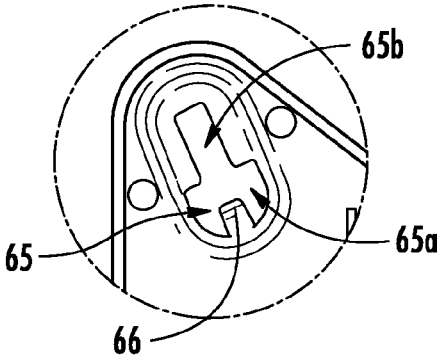
FIG. 9 is a detail view of the mounting bracket of FIG. 4.

As shown in FIG. 9, the aperture 65 is configured having a Y-shape that includes a D-shaped portion 65*a* with a member 66 that extends into the arc portion of the D-shaped portion 65*a* to define the Y-shape. The aperture 65 also includes a narrow extended portion 65B that may be configured wide enough to permit the shank of the fastener 9 to pass therethrough, but to prohibit the head of the fastener 9 from passing therethrough, while the width of the D-shaped portion 65*a* may be configured wide enough to permit the head of the fastener 9 to pass through.

Figure 10:
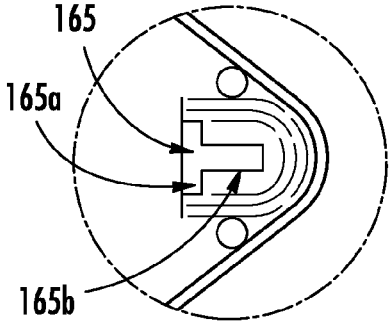
FIG. 10 is a detail view of the mounting bracket of FIG. 4.

As shown in FIG. 10, the aperture 165 is configured having a T-shape that includes a base portion 165*a* and a leg portion 165*b*. The leg portion 165*b* of the aperture 165 may be wide enough to permit the shank of the fastener 9 to pass therethrough, but to prohibit the head of the fastener 9 from passing therethrough. The base portion 165*a* of the aperture 165 may be wide enough to permit the head of the fastener 9 to pass therethrough.

These arrangements of the apertures (e.g., aperture 65, aperture 165) and mounting locations 62 may allow the fastener 9 to be attached to the mounting bracket 6, such as prior to coupling the mounting bracket 6 to the tank 2. In addition, these arrangements may allow each fastener 9 to retain the mounting bracket 6 in place relative to the bowl 3 when the attachment assembly 4 is coupled to the bowl 3 by clamping the portions of the mounting surfaces 63 that are adjacent to the aperture 65 (e.g., the narrow extended portion 65*b* of the Y-shaped aperture 65, leg portion 165*b* of the T-shaped aperture 165) to the bowl 3. It should be noted that the apertures in the mounting locations (e.g., mounting surfaces) may be configured to have any suitable shape and the embodiments disclosed here are meant as examples and are not limiting.

Figure 5:
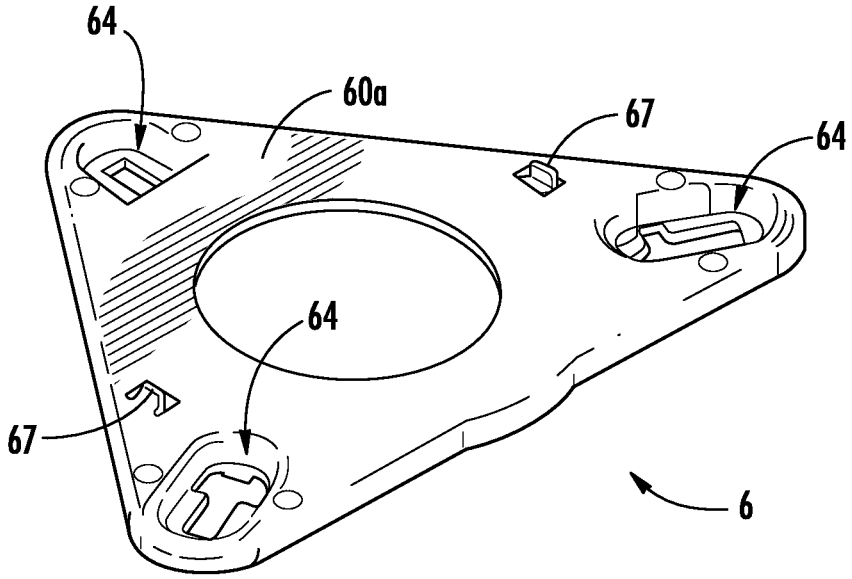
FIG. 5 is another perspective view of the mounting bracket of FIG. 4.

The mounting bracket 6 may also include an anti-rotation feature, such as to prohibit relative rotation between the tank 2 and the mounting bracket 6 about a vertical axis. In other words, the anti-rotation tab prohibits the yaw adjustment of the tank 2 relative to the bowl 3. As shown in FIG. 5, the anti-rotation feature includes a tab 67 that is formed from the base 60 of the mounting bracket 6, where the tab 67 extends in an upward direction toward the tank 2. The tab 67 is configured to engage a receiving feature, such as an indentation or recess in the bottom 21, of the tank 2 to prohibit relative rotation between the tank 2 and the mounting bracket 6. The tab 67 may also serve as a guide in aligning the tank 2 about the yaw axis relative to the bowl 3 and/or attachment assembly 4, such as when securing the tank 2 to the bowl 3. The mounting bracket may include more than one anti-rotation feature. As shown in FIG. 5, the mounting bracket 6 includes two tabs 67 that are disposed on opposing sides of the central opening 61. However, the tabs 67 may be located anywhere on the mounting bracket 6.

The mounting bracket 6 may also include a flange 68 that extends from the base 60, such as, to increase the strength of the mounting bracket 6. As shown in FIG. 4, the flange 68 extends continuously around the outer profile or perimeter of the mounting bracket 6 to increase the strength of the bracket. The length that the flange 68 extends from the base 60 may be tailored to provide the desired strength of the mounting bracket 6. It should be noted that the flange may be configured differently. For example, the flange 68 may be configured to extend discontinuously (i.e., in a broken or intermittent fashion) around the mounting bracket or a portion of the mounting bracket. The mounting bracket 6 may also include additional features to increase its strength. For example, the mounting bracket 6 may include gussets, embosses, ribs, or any suitable strengthening feature.

Figure 6:
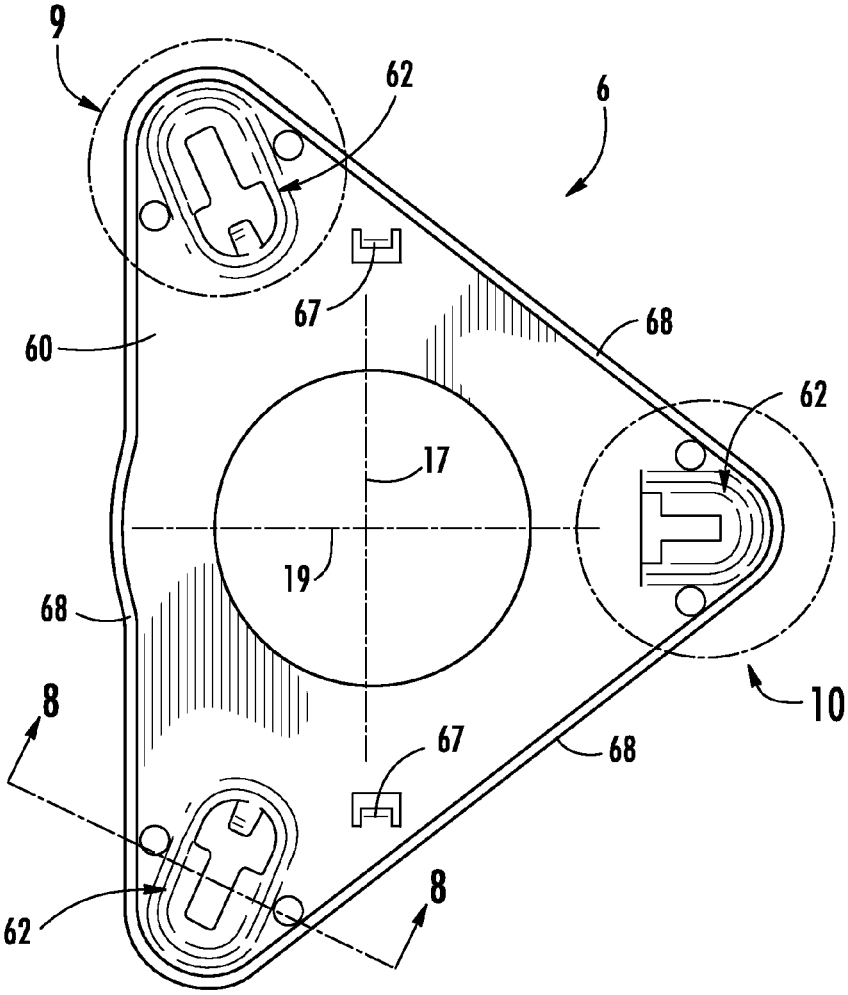
FIG. 6 is a plan view of the mounting bracket of FIG. 4.
Figure 7:
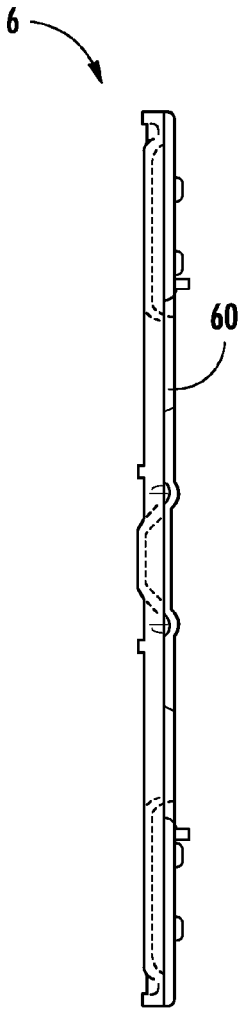
FIG. 7 is a right-side view of the mounting bracket of FIG. 4.
Figure 8:
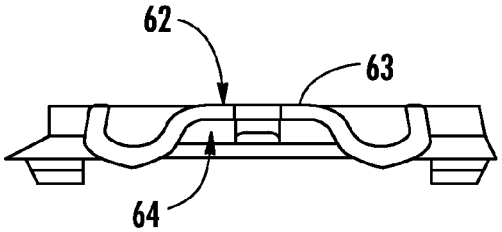
FIG. 8 is a side view of the mounting bracket of FIG. 4 taken along line 8-8.

Although, the mounting bracket 6 is disclosed as having three mounting locations, it should be noted that the mounting bracket 6 may include any number of mounting locations and may be configured having any suitable shape. For example, a mounting bracket could be configured having a generally rectangular shape wherein the mounting bracket includes four mounting locations with one mounting location disposed near each corner of the rectangular mounting bracket. The attachment assembly 4 having a mounting bracket 6 comprising at least three mounting locations may advantageously provide for easier adjustability and/or a greater level of adjustability of the tank relative to the bowl, such as leveling of the tank, when compared to conventional two-point attachment assemblies. For example, the attachment assembly 4 having the mounting brackets 6 with three mounting locations 62 as disclosed herein may allow for adjustability of the tank 2 relative to the bowl 3 about two-axes of rotation. The first axis may be a lateral axis 17 (as shown in FIG. 6), in which the pitch of the tank 2 can be adjusted thereabout. The second axis may be a fore-aft axis 19 (as shown in FIG. 6), in which the roll of the tank 2 can be adjusted thereabout. It should be noted that the attachment assembly 4 may also be configured so that the yaw of the tank 2 can be adjusted about a third axis (e.g., vertical axis) relative to the bowl 3, such as when the mounting bracket 6 of the attachment assembly 4 is configured without the anti-rotation feature (e.g., the tab 67).

Conversely, a two-point attachment assembly allows for adjustment of the tank 2 relative to the bowl 3 about only a single axis of rotation. For example, a two-point attachment assembly having one attachment location disposed on the left-side of the valve and the other disposed on an opposing right-side of the valve may provide only for the roll adjustment of the tank 2 relative to the bowl 3.

Figure 11:
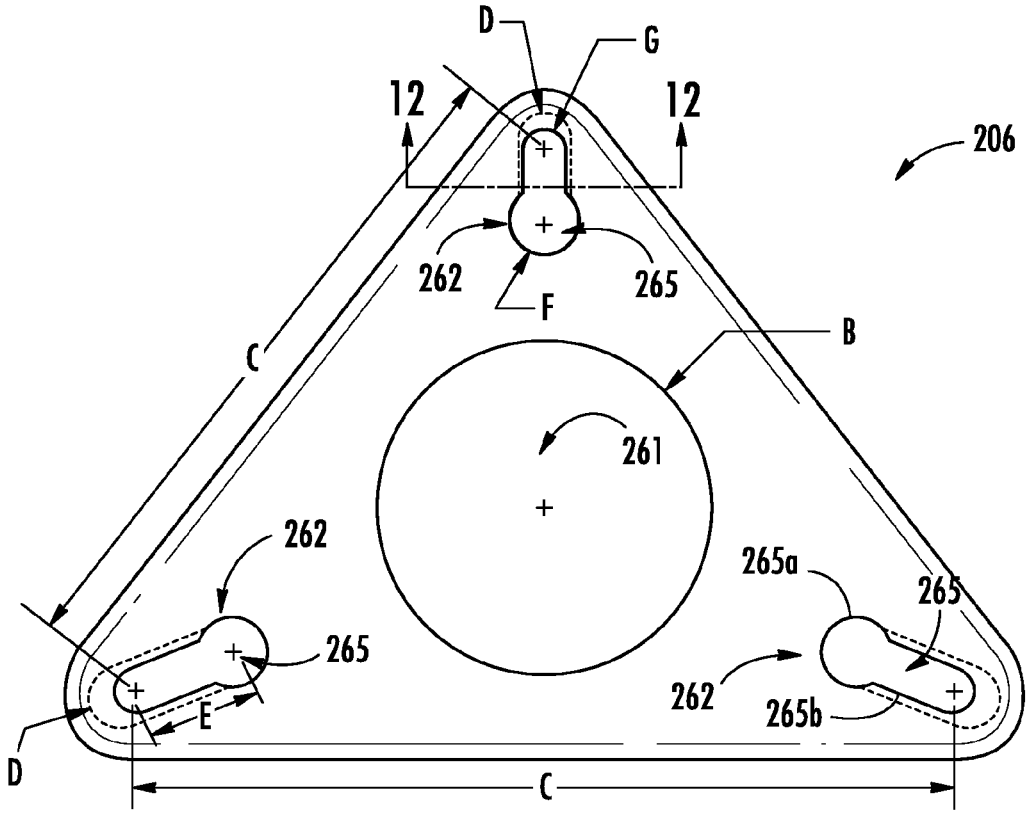
FIG. 11 is a plan view of another exemplary embodiment of a mounting bracket.
Figure 12:
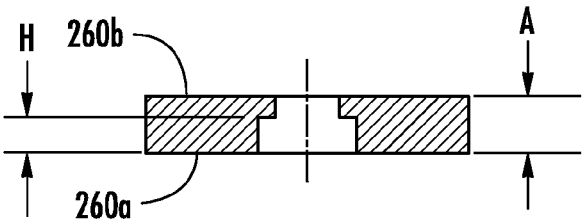
FIG. 12 is a cross-sectional view of the mounting bracket of FIG. 14.

FIGS. 11-12 illustrate another exemplary embodiment of a mounting bracket 206 for use in an attachment assembly, such as the attachment assembly 4. The mounting bracket 206 may be configured as a relatively flat member having a generally triangular shape with a thickness A that is approximately 6.35 mm (0.25 inches). A top surface 260*a* of the mounting bracket 206 is configured to be disposed toward the bottom surface of the bottom 21 of the tank 2, and a bottom surface 260*b* of the mounting bracket 206 is configured to be disposed toward the valve nut 7 and/or the gasket 8 of the valve assembly 5.

The mounting bracket 206 includes a central aperture 261 (e.g., opening) that is configured to receive the end 52 of the valve 5 so that the mounting bracket 6 may slide over the valve body 51, such as during attachment of the tank 2 to the bowl 3 through the attachment assembly 4. As shown, the aperture 261 is a circular hole having a diameter B that is approximately 63.5 mm (2.5 inches). However, the size and shape of the aperture 261 may be configured differently, which may be configured at least slightly greater than the outer diameter of the valve body 51, so the valve body 51 can pass through the aperture 261.

The mounting bracket 206 also includes a plurality of mounting locations 262, where each mounting location 262 is configured to help secure the mounting bracket 206 to another component of the toilet 1, such as the bowl 3. As shown, the mounting bracket 206 includes three mounting locations 262 with one mounting location 262 provided near each of the three corners of the generally triangular shaped mounting bracket 206, where the mounting locations 262 have a spacing C of approximately 127-152.4 mm (5-6 inches). It should be noted that the spacing may be different between the mounting locations 262. For example, the spacing between a first mounting location 262 and a second mounting location 262 may be approximately 127 mm, and the spacing between a second mounting location 262 and a third mounting location 262 may be approximately 152.4 mm. Each mounting location 262 includes an opening 265 that is configured to receive a fastener or other coupling member to secure the mounting bracket 206 and the attachment assembly to the toilet, such as to the bowl. The opening 265 or a portion thereof may be configured having a counterbore, such that the opening has a first shape on the top surface 260*a* and a second shape (that differs from the first shape) on the bottom surface 260*b*. As shown, the top surface 260*a* of the opening 265 has a slot shape having a diameter D that is approximately 11.13 mm (0.438 inches) and a length E that is approximately 19.05 mm (0.75 inches). As shown, the bottom surface 260*b* of the opening 265 includes a circular portion 265*a* and a slot portion 265*b*, where the circular portion 265*a* has a diameter F that is approximately 12.7 mm (0.5 inches) and the slot portion 265*b* has a diameter G that is approximately 7.94 mm (0.313 inches). The slot shape portion of the opening 265 may have a depth H of 4.32 mm (0.17 inches) from the top surface 260*a*. This configuration allows for the head of the fastener (e.g., fastener 9) that couples the mounting bracket 206 to the bowl (e.g., bowl 3) of the toilet (e.g., toilet 1) to be recessed into the mounting bracket 206, such that the top of the head of the fastener sits below the top surface 260*a* of the mounting bracket 206. The width of the slot portion of the bottom surface 260*b* may be configured small enough to prohibit the head of the fastener from passing through, but large enough to allow the shank of the fastener to pass through.

It should be noted that although some of the exemplary embodiments are illustrated having dimensions for specific features of the mounting brackets, these dimensions are used to disclose an example and are not limiting. Thus, the specific features of the mounting brackets may have different sizes and may have different configurations as those disclosed herein.

The valve nut 7 is configured to be coupled to the valve 5 to secure the attachment assembly 4 to the tank 2. The valve nut 7 may include an annular body 71 having an opening 72 that is configured to receive the valve body 51 therethrough, such as during assembly of the attachment assembly 4 to the tank 2. The inner surface of the body 71 of the valve nut 7 may include internal threads configured to thread to external threads of the valve body 51, such as threads disposed on the end 52 of the valve 5. The valve nut 7 may also include a feature to facilitate threading of the valve nut 7 to the valve 5. For example, the outer surface of the body 71 may include a hexagonally-faceted arrangement 73 to facilitate rotating the valve nut 7 via a wrench or other tool. Alternatively, the body 71 of the valve nut 7 may include a faceted arrangement having any number of surfaces, or may include any suitable feature that facilitates coupling the valve nut 7 to the valve 5.

The gasket 8 is configured to seal the connection between the attachment assembly 4 and the bowl 3 of the toilet 1 to prohibit water from leaking therebetween. The gasket 8 may include an annular member 81 have an inner surface 82 defined by an opening, where the inner surface 82 and opening therein are configured to receive the valve body 51, such as during assembly of the attachment assembly 4 to the tank 2. The external surface 83 of the annular member 81 is configured to seal to the bowl 3, such as to the surface of the bowl 3 that defines the inlet opening 36 in the ledge 34. Accordingly, the external surface 83 of the gasket 8 may be configured to mate with the bowl 3. For example, the external surface 83 may include a convex shape that seals to a mating concave surface of the bowl 3, or vice versa. As another example, the external surface 83 may include an angled (e.g., chamfered) shape that seals to a mating angled surface of the bowl 3. The gasket 8 may be made from a rubber material, a polymeric material, or any suitable material, and may include any suitable shape or configuration to seal the attachment assembly 4 to the bowl 3. The annular member 81 may also include a pocket 84, such as in an inner surface 82, where the pocket 84 is configured to receive the valve nut 7 during assembly of the attachment assembly 4 to the tank 2. The pocket 84 may be disposed on the top side of the member 81, such that the pocket 84 does not extend completely through the member 81.

The method for assembling or securing the tank 2 to the bowl 3 involves a five step process. The first assembly step involves engaging the valve body 51 of the valve 5 from inside the tank 2 to the tank 2, such that the end 52 of the valve 5 passes through the outlet opening 23 in the tank 2, where a portion of the valve 5, such as a shoulder 53 shown in FIG. 3, engages (e.g., abuts) the inside surface 21*a* and/or the outlet opening 23 of the bottom 21 of the tank 2. The shoulder 53 of the valve 5 may be configured to limit the travel of the valve 5 relative to the tank 2 and may also facilitate the retention of the valve 5 to the tank 2, such as through a clamp force once the valve nut 7 is coupled to the valve 5. The shoulder 53 of the valve 5 may also be configured to prohibit leaking between the valve 5 and the tank 2. A seal (not shown) may also be used to reduce the likelihood of leaking between the valve 5 and the tank 2. The second assembly step involves moving (e.g., sliding) the mounting bracket 6 with the coupled fasteners 9 into engagement with the valve body 51, such that the end 52 engages (and passes through) the opening 61 of the mounting bracket 6. Accordingly, the fasteners 9 may be preassembled to the mounting bracket 6. The third step involves securing the mounting bracket 6 (and the valve 5) to the tank 2 by coupling the valve nut 7 to the valve 5. For example, the valve nut 7 may be threaded onto mating threads on the end 52 of the valve 5 to provide a clamp force into the tank 2 and mounting bracket 6 by the coupled valve 5 and valve nut 7. The fourth assembly step involves placing the gasket 8 between the valve nut 7 and the bowl 3. The gasket 8 may be coupled to the valve nut 7 or may be inserted into the inlet opening 36 of the bowl 3 to provide a seal between the attachment assembly 4 and the bowl 3 once assembled. It should be noted that the fourth assembly step is optional, as the gasket 8 may be integrally formed with the valve nut 7 or bowl 3, or may not be required at all. The fifth assembly step involves securing the tank 2 to the bowl 3 through the attachment assembly 4 by attaching the tank 2 to the bowl 3. The tank 2 may be positioned with the end 52 of the valve 5 and gasket 8 being provided in the inlet opening 36 of the bowl 3 and with the fasteners 9 of the attachment assembly 4 engaging the holes 37 in the ledge 34 of the bowl 3. Nuts or other suitable devices may thread onto the fasteners 9 to induce a clamp force onto the mounting bracket 6 of the attachment assembly 4 and the bowl 3 to secure the tank 2 to the bowl 3.

Once the tank 2 is secured to the bowl 3, the position of the tank 2 may be adjusted relative to the bowl 3, such as to level the tank 2 thereto, by adjustment of one or more than one of the fasteners 9 of the attachment assembly 4. As shown in FIGS. 1-3, the mounting bracket 6 has a alignment relative to the bowl 3, where two of the mounting locations 62 are provided forward of the center of the inlet opening 36 of the bowl 3 and one mounting location 62 is provided rearward of the center of the inlet opening 36. Accordingly, the pitch of the tank 2 (relative to the bowl 3) may be adjusted about the lateral axis 17 by adjusting the fastener 9 disposed in the rearward mounting location 62 and/or at least one of the fasteners 9 disposed in the forward mounting locations 62. Furthermore, the roll of the tank 2 (relative to the bowl 3) may be adjusted about the fore-aft axis 19 by adjusting either or both of the fasteners 9 disposed in the forward mounting locations 62.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the toilets and attachment assemblies or systems as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. A toilet comprising:

a tank having a bottom;

a bowl; and an attachment assembly configured to secure the bottom of the tank to the bowl, the attachment assembly comprising:

a mounting bracket having at least three mounting locations spaced apart around an opening;

a valve configured to fluidly connect the tank and the bowl, the valve being configured to engage the bottom of the tank and the opening in the mounting bracket;

a valve nut configured to couple to the valve to secure the mounting bracket between the valve nut and the tank;

a gasket disposed between the valve nut and an inlet opening of the bowl to prohibit leaking, wherein the gasket is directly coupled to the valve, the valve nut, and the mounting bracket; and at least three fasteners configured to secure the mounting bracket to the bowl;

wherein the at least three fasteners are disposed external to the tank and couple the tank to the bowl without directly engaging the tank;

wherein the pitch of the tank is adjustable relative to the bowl about a lateral axis through adjustment of at least one of the at least three fasteners; and wherein the roll of the tank is adjustable relative to the bowl about a fore-aft axis through adjustment of at least one of the at least three fasteners.

2. The toilet of claim 1, wherein an inner surface of the gasket is directly coupled to the valve nut.

3. The toilet of claim 2, wherein the gasket further includes an outer surface having a convex shape that directly contacts a mating concave surface of a ledge of the bowl to seal the connection between the attachment assembly and the bowl.

4. The toilet of claim 1, wherein one of the three mounting locations is provided rearward of a lateral axis and substantially on a fore-aft axis, and the other two mounting locations are provided on opposing sides of the fore-aft axis forward of the lateral axis.

5. The toilet of claim 1, wherein the mounting bracket includes a tab that extends from a base of the mounting bracket, wherein the tab is configured to engage the bottom of the tank to prevent relative rotation between the mounting bracket and the tank, and wherein the mounting bracket is in direct contact with the bottom of the tank.

6. The toilet of claim 1, wherein at least one mounting location includes a closed aperture configured to receive and retain a fastener therein, wherein each aperture includes a slotted portion and a semi-circular portion.

7. The toilet of claim 6, wherein a member extends into the semi-circular portion.

8. The toilet of claim 7, wherein at least one other mounting location includes a closed T-shaped aperture configured to receive and retain a second fastener therein, wherein the T-shaped aperture includes a base portion that is wider than a head of the second fastener and leg portion that is narrower than a head of the second fastener.

9. The toilet of claim 1, wherein at least one mounting location includes a closed aperture configured to receive and retain a fastener therein, wherein the aperture includes a base portion and leg portion forming a T-shape.

10. The toilet of claim 1, wherein the mounting bracket includes a base, which includes the opening, and a flange that extends from an outer periphery of the base toward the bowl, and wherein at least a portion of the flange contacts the bowl.

11. An attachment assembly for securing a toilet tank to a toilet bowl, the attachment assembly comprising:

a mounting bracket having at least three mounting locations spaced apart around an opening;

a valve configured to engage the opening in the mounting bracket to fluidly connect the tank and the bowl;

a valve nut configured to couple to the valve to secure the mounting bracket between the tank and the valve nut;

a gasket disposed between the valve nut and an inlet opening of the bowl to prohibit leaking, wherein the gasket is directly coupled to the valve, the valve nut, and the mounting bracket; and at least three fasteners configured to secure the mounting bracket to the bowl;

wherein the at least three fasteners are disposed external to the tank and couple the tank to the bowl without directly engaging the tank; and wherein each mounting location further includes a closed aperture having either a Y-shape or a T-shape.

12. The attachment assembly of claim 11, wherein an inner surface of the gasket is directly coupled to the valve nut.

13. The attachment assembly of claim 11, wherein the mounting bracket includes a base having the opening therein, wherein each of the three mounting locations includes a mounting surface that is offset from the base and configured to contact the toilet bowl.

14. The attachment assembly of claim 11, wherein at least one mounting location includes the closed Y-shaped aperture and at least one mounting location includes the closed T-shaped aperture.

15. The attachment assembly of claim 11, wherein one of the three mounting locations is provided rearward of a lateral axis and substantially on a fore-aft axis, and the other two mounting locations are provided on opposing sides of the fore-aft axis forward of the lateral axis, wherein the pitch of the tank is adjustable relative to the bowl about the lateral axis through adjustment of the attachment assembly.

16. The attachment assembly of claim 15, wherein the roll of the tank is adjustable relative to the bowl about the fore-aft axis through adjustment of the attachment assembly.

17. The attachment assembly of claim 11, wherein the valve nut directly contacts the mounting bracket to clamp the mounting bracket directly to the toilet tank.

18. The attachment assembly of claim 11, wherein each mounting portion also includes a clamping portion provided on each side of and defining the aperture, and wherein each clamping portion is configured to be clamped directly to the bowl by one of the fasteners.

19. The attachment assembly of claim 11, wherein the mounting bracket includes a base, which includes the opening, and a flange that extends around a periphery of the base.

20. The attachment assembly of claim 19, wherein the flange extends continuously around the periphery.

* * * * *